US008474424B2

(12) United States Patent
Meintschel et al.

(10) Patent No.: US 8,474,424 B2
(45) Date of Patent: Jul. 2, 2013

(54) VALVE DRIVE TRAIN DEVICE

(75) Inventors: Jens Meintschel, Bernsdorf (DE); Thomas Stolk, Kirchheim (DE); Alexander von Gaisberg-Helfenberg, Beilstein (DE)

(73) Assignee: Daimler AG, Stuttgart (DE)

( * ) Notice: Subject to any disclaimer, the term of this patent is extended or adjusted under 35 U.S.C. 154(b) by 377 days.

(21) Appl. No.: 12/927,117

(22) Filed: Nov. 5, 2010

(65) Prior Publication Data

US 2011/0079188 A1 Apr. 7, 2011

(30) Foreign Application Priority Data

Jun. 20, 2008 (DE) ..... 10 2008 029 325

(51) Int. Cl.
*F01L 1/34* (2006.01)

(52) U.S. Cl.
USPC ..... 123/90.18

(58) Field of Classification Search
USPC ..... 123/90.16, 90.18
See application file for complete search history.

(56) References Cited

U.S. PATENT DOCUMENTS

| | | | | |
|---|---|---|---|---|
| 5,289,806 | A * | 3/1994 | Hurr | 123/90.17 |
| 6,474,281 | B1 * | 11/2002 | Walters | 123/90.18 |
| 6,745,736 | B2 * | 6/2004 | Walters | 123/90.18 |
| 7,404,383 | B2 * | 7/2008 | Elendt | 123/90.16 |
| 7,409,938 | B2 * | 8/2008 | Dengler | 123/90.18 |
| 7,472,671 | B2 * | 1/2009 | Elendt et al. | 123/90.6 |
| 8,161,930 | B2 * | 4/2012 | Elendt et al. | 123/90.6 |
| 8,186,320 | B2 * | 5/2012 | Schiepp et al. | 123/90.18 |
| 8,191,524 | B2 * | 6/2012 | Elendt et al. | 123/90.6 |
| 2003/0051687 | A1 * | 3/2003 | Walters | 123/90.18 |
| 2003/0192496 | A1 * | 10/2003 | Walters | 123/90.18 |
| 2005/0011480 | A1 | 1/2005 | Schultz et al. | |
| 2007/0178731 | A1 * | 8/2007 | Elendt | 439/157 |
| 2007/0204819 | A1 * | 9/2007 | Elendt et al. | 123/90.16 |
| 2008/0149059 | A1 * | 6/2008 | Murphy et al. | 123/90.39 |
| 2008/0236526 | A1 * | 10/2008 | Yamamoto et al. | 123/90.16 |
| 2009/0071427 | A1 * | 3/2009 | Mock et al. | 123/90.18 |
| 2010/0108006 | A1 * | 5/2010 | Elendt et al. | 123/90.17 |
| 2010/0175652 | A1 * | 7/2010 | Schoeneberg et al. | 123/90.21 |
| 2010/0180843 | A1 * | 7/2010 | Meintschel et al. | 123/90.15 |
| 2010/0199934 | A1 * | 8/2010 | Meintschel et al. | 123/90.15 |
| 2010/0199935 | A1 * | 8/2010 | Lengfeld et al. | 123/90.15 |
| 2010/0237264 | A1 * | 9/2010 | Lengfeld et al. | 251/89 |
| 2010/0251982 | A1 * | 10/2010 | Elendt et al. | 123/90.18 |
| 2010/0269769 | A1 * | 10/2010 | Schoeneberg et al. | 123/90.6 |
| 2011/0079188 | A1 * | 4/2011 | Meintschel et al. | 123/90.15 |
| 2011/0079190 | A1 * | 4/2011 | Meintschel et al. | 123/90.17 |
| 2011/0079191 | A1 * | 4/2011 | Lengfeld et al. | 123/90.18 |
| 2011/0185995 | A1 * | 8/2011 | Deblaize et al. | 123/90.18 |
| 2012/0031361 | A1 * | 2/2012 | Ickinger et al. | 123/90.18 |

(Continued)

FOREIGN PATENT DOCUMENTS

| | | |
|---|---|---|
| DE | 100 54 623 | 5/2002 |
| DE | 101 48 177 | 4/2003 |

(Continued)

*Primary Examiner* — Thomas Denion
*Assistant Examiner* — Steven D Shipe
(74) *Attorney, Agent, or Firm* — Klaus J. Bach

(57) ABSTRACT

In a valve drive train device, particularly of an internal combustion engine, having an actuating device provided to displace at least one first axially displaceable cam element using a shifting gate, the actuating device is designed for switching the axially displaceable first cam element into the various switching positions.

9 Claims, 7 Drawing Sheets

U.S. PATENT DOCUMENTS

| | | | | |
|---|---|---|---|---|
| 2012/0125274 | A1 * | 5/2012 | Werler et al. | 123/90.15 |
| 2012/0138000 | A1 * | 6/2012 | Schadel et al. | 123/90.18 |
| 2012/0138001 | A1 * | 6/2012 | Werler et al. | 123/90.18 |
| 2012/0235777 | A1 * | 9/2012 | Elendt et al. | 335/229 |

FOREIGN PATENT DOCUMENTS

| | | | |
|---|---|---|---|
| DE | 102 41 920 | | 3/2004 |
| DE | 102004022832 | A1 * | 12/2005 |
| DE | 20 2007 013 509 | | 1/2008 |
| DE | 10 2007 010 152 | | 4/2008 |
| DE | 102006051809 | A1 * | 5/2008 |
| DE | 10 2007 010 156 | | 9/2008 |
| DE | 102007024598 | A1 * | 11/2008 |
| DE | 102007024600 | A1 * | 11/2008 |
| DE | 10 2007 040 677 | | 3/2009 |
| DE | 10 2007 061 353 | | 6/2009 |
| DE | 102008020892 | A1 * | 10/2009 |
| DE | 102008020893 | A1 * | 10/2009 |
| DE | 102008024911 | A1 * | 11/2009 |
| DE | 102008054254 | A1 * | 5/2010 |
| DE | 102009007819 | A1 * | 8/2010 |
| DE | 102009053116 | A1 * | 9/2010 |
| DE | 102010013216 | A1 * | 10/2010 |
| DE | 102009021650 | A1 * | 11/2010 |
| EP | 1 428 991 | | 6/2004 |
| WO | WO 2005/080761 | | 9/2005 |
| WO | WO 2006/012959 | | 2/2006 |

* cited by examiner

VALVE DRIVE TRAIN DEVICE

This is a Continuation-In-Part Application of pending international patent application PCT/EP2009/003902 filed May 30, 2009 and claiming the priority of German patent application 10 2008 029 325.3 filed Jun. 20, 2008.

BACKGROUND OF THE INVENTION

The invention relates to a valve drive train device including an actuating device for shifting an axially displaceable cam element by means of a shift gate to at least three axial operating positions.

A valve drive train devices, in particular of an internal combustion engine, with an actuating device which is provided to displace at least one first axially displaceable cam element into at least three operating positions by means of a shift gate is already known from DE 10 2007 010 152 A1.

It is the principal object of the present invention to provide a valve train device with a high flexibility.

SUMMARY OF THE INVENTION

In a valve drive train device, particularly of an internal combustion engine, having an actuating device provided to displace at least one first axially displaceable cam element using a shifting gate, the actuating device is designed for switching the at least one axially displaceable first cam element into at least three switching positions.

A valve drive train device can thereby be highly flexible due to the high number of switching positions and can be adapted to different operating modes of the internal combustion engine, in particular different combustion operating modes. A "switching position" is thereby in particular meant to be a switching position of the cam element, to which a defined cam lift can be assigned. If the valve drive train device has several cam elements, the "same switching positions" means that the respective cam elements have a same valve lift. "Provided" is in particular meant to be especially equipped, designed and/or programmed. The cam element preferably has at least one cam set with at least three partial cams, wherein each partial cam advantageously can be assigned to a switching position and each cam set to an engine inlet or outlet valve.

It is further suggested that the actuating device is provided to switch a zero lift, a partial lift and/or a full lift. A valve train device that can switch these switching positions is particularly advantageous, as an efficiency of the internal combustion engine, in particular of an internal combustion engine for a passenger vehicle can be increased thereby in a simple manner. A zero lift is meant to be a cam lift of zero. A "partial lift" is particularly meant to be a cam lift which is smaller than a cam lift of the full lift. In principle, it is however also conceivable to switch other switching positions, as for example a full lift, a partial lift and a brake lift for an engine braking operation.

It is further suggested that the shifting gate has at least two switch segments which are provided to displace the first cam element into a switching direction. An arrangement according to the invention can be formed thereby which is constructively particularly simple. The switching direction is preferably formed as a first switching direction and it is suggested that the shifting gate has at least two further switch segments, which are provided to switch the cam element into a second switching direction, wherein the second switching direction is preferably opposite to the first switching direction. It is thereby suggested in particular that the switch segments for the first switching direction are assigned to a first gate path of the shifting gate. It is further suggested that the two further switch segments for the second switching direction are assigned to a second gate path of the shifting gate.

The shifting gate preferably has at least two further switch segments, which are provided to displace a second cam element into the switching direction. A second cam element can thereby also be displaced in three switching positions. The switch segments, by means of which the second cam element can be displaced into the first switching direction, are preferably also assigned to the first gate path. It is particularly advantageous if the shifting gate has two further switch segments which are arranged in the second gate path and which are provided to displace the second cam element into the second switching direction.

It is thus suggested in particular that the shifting gate has the two gate paths, which respectively have four of the switch segments, wherein the switch segments of a gate path are preferably assigned to a switching direction. It is thereby in particular advantageous if the switch segments of a gate path are alternately assigned to the cam elements.

In a further development of the invention, it is suggested that the shifting gate is provided to sequentially displace the first cam element and the second cam element. A particularly advantageous switching sequence can be found thereby, as one can thereby switch into different switching positions in a particularly simple manner.

In a particularly preferred arrangement of the invention, the actuating device has a reset unit, which is provided to terminate a switching action. A switching action can thereby be terminated at a defined time in a simple manner, whereby a high number of possible combinations of the switching position can be achieved in a simple manner by means of the switch segments. "Terminating" in this connection is meant to be in particular a premature termination prior to an end of the shifting gate, as in particular an interruption or a stopping. A "switching action" is in particular meant to be a displacement of the cam element, wherein a "switching action" is in particular meant to be a displacement of one of the cam elements with several cam elements.

It is further suggested that the reset unit is provided to terminate the switching action immediately after a displacement of the first cam element. An advantageous time for terminating the switching action can be found thereby. In particular, the first cam element can thereby be displaced at least partially independently from the second cam element.

In a particularly advantageous arrangement of the invention, the reset unit is provided to terminate the switching action after a displacement of the second cam element. A further advantageous time for terminating the switching action can be found thereby. In particular, the second cam element can thereby be displaced at least partially independently from the first cam element.

The reset unit preferably has at least one switch unit with a switch element, which is provided to be moved into a neutral position by means of an actuator. The switching action can thereby be terminated in a simple manner and in particular independently from the shifting gate.

In a further advantageous arrangement of the invention, the shifting gate has at least one intermediate segment which is provided to terminate the switching process. The switching process can thereby also be terminated in a simple manner and in particular independently from switch units of the actuating device, by means of which the cam elements are displaced.

The invention will become more readily apparent from the following description thereof with reference to of the accompanying drawings.

BRIEF DESCRIPTION OF THE DRAWINGS

It is shown in.

DESCRIPTION OF PARTICULAR EMBODIMENTS

Figure 1:
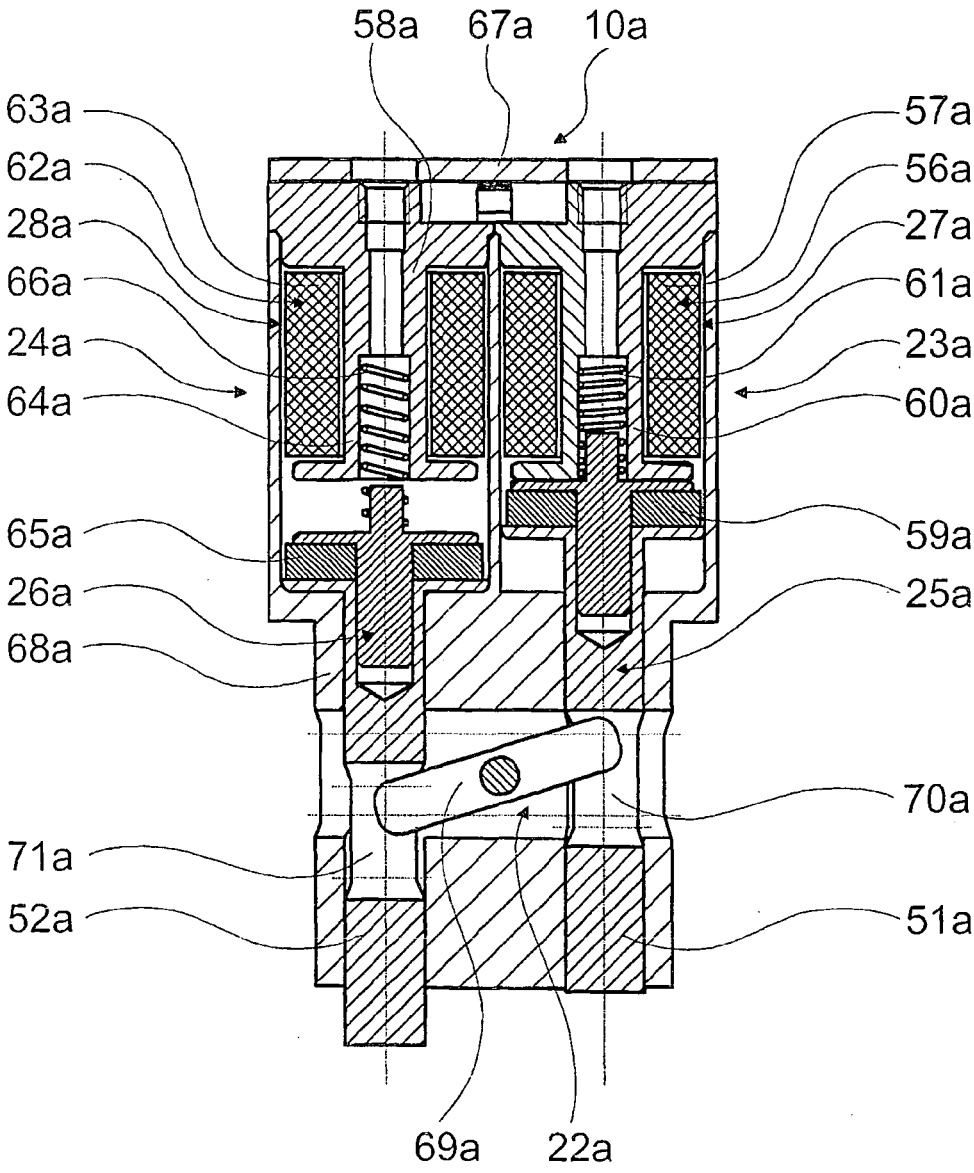
FIG. 1 an actuating device of a valve train device with two switch units in a cross-sectional view, FIG. 2 the actuating device in a perspective view, FIG. 3 schematically a shifting gate in a planar view, FIG. 4 a schematized overview of the valve train device, FIG. 5 schematically a shifting gate of an actuating device of a further valve train device in a planar view, FIG. 6 a gate path of the shifting gate in a cross section, FIG. 7 the valve train device in a schematized overview and FIG. 8 a switch unit of the actuating device.
Figure 2:
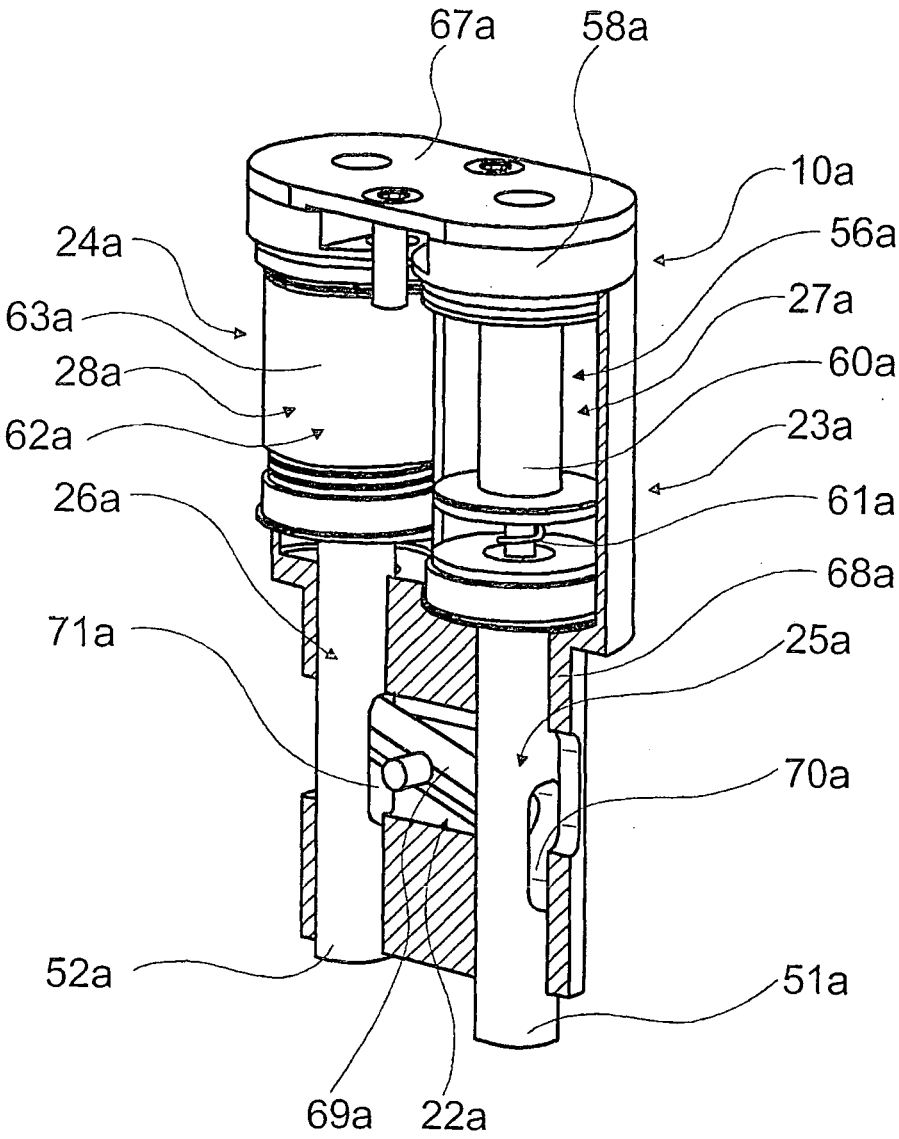

FIG. 1 and FIG. 2 show an actuating device 10*a* of a valve train device. The actuating device 10*a* is provided to move two cam elements 11*a*, 12*a* which are arranged on a base camshaft 35*a* in an axially displaceable and torque-proof manner. In order to move the cam elements 11*a*, 12*a*, the actuating device 10*a* has a first and a second switch unit 23*a*, 24*a*, which can displace the cam elements 11*a*, 12*a* by means of a shifting gate.

The shifting gate 13*a* has a first gate path 36*a* and a second gate path 37*a*. The gate paths 36*a*, 37*a*, by means of which the cam elements 11*a*, 12*a* are displaced, are designed as groove-shaped recesses and are formed directly into the cam elements 11*a*, 12*a*. In order to displace the cam elements 11*a*, 12*a* sequentially, the cam elements 11*a*, 12*a* are designed L-shaped and intersecting axially in a region where they abut. In the circumferential direction, each cam element 11*a*, 12*a* extends over on a rotary angle of 180° in the region of the gate paths 36*a*, 37*a*. The gate paths 36*a*, 37*a*, which extend over a rotary angle larger than 360° degrees, are respectively arranged partially on the cam element 11*a* and partially on the cam element 12*a*.

Figure 3:
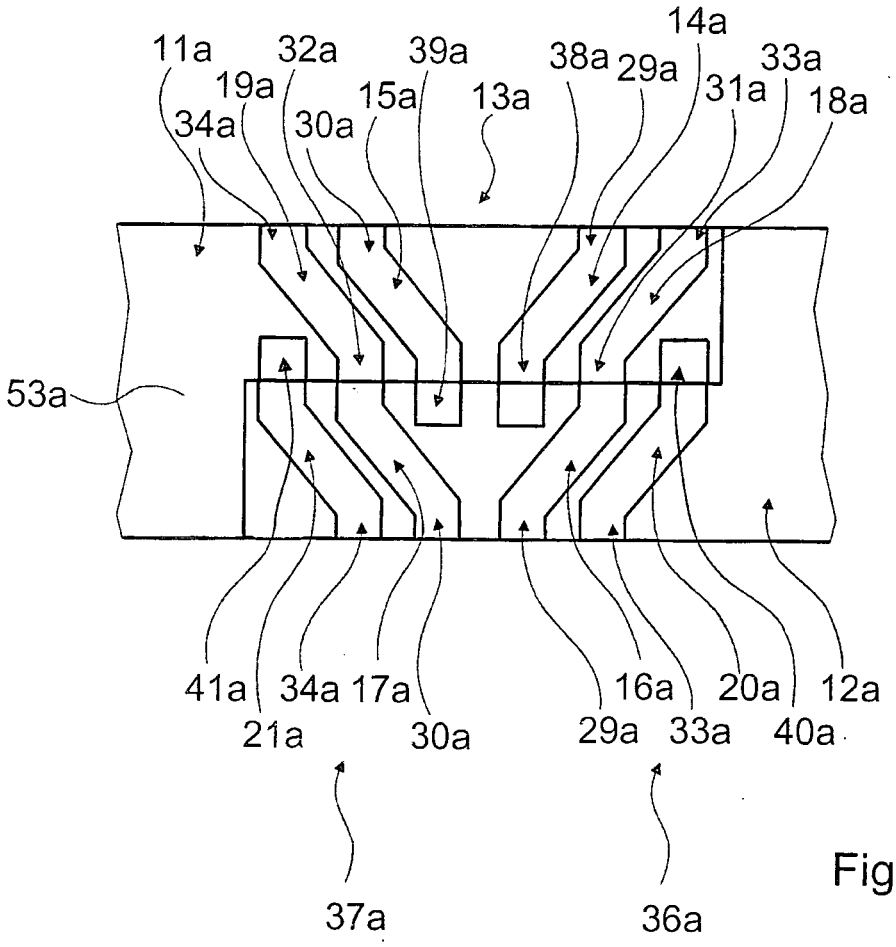
Figure 4:
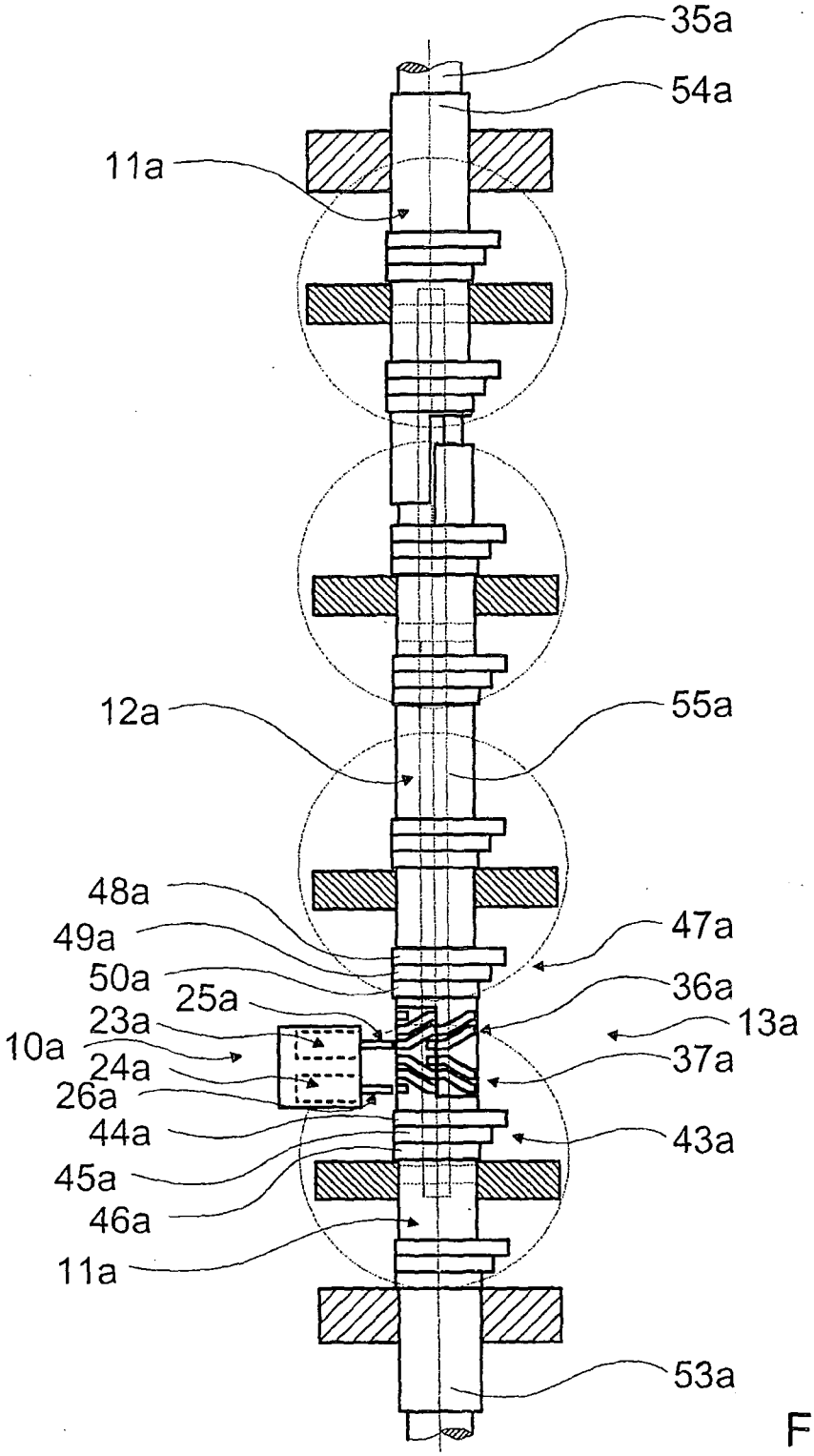

Both gate paths 36*a*, 37*a* have a base shape with a fourfold S-shaped structure (see FIG. 3). Both gate paths 36*a*, 37*a* respectively have a meshing segment 38*a*, 39*a*, four switch segments 14*a*-21*a*, three intermediate segments 29*a*-34*a* and a disengagement segment 40*a*, 41*a*. The switch segments 14*a*, 16*a*, 18*a*, 20*a* of the first gate path 36*a* have an axial direction component, which is opposed to a first switching direction, whereby an axial force for switching into the first switching direction can be generated by means of the switch segments 14*a*, 16*a*, 18*a*, 20*a* and of a rotary movement of the cam element 11*a*. The switch segments 15*a*, 17*a*, 19*a*, 21*a* of the second gate path 37*a* have an axial direction component which is axially opposed to a second switching direction, whereby an axial force for switching into the second switching direction can be generated in an analogous manner.

In the first gate path, alternately one of the switch segments 14*a*, 16*a*, 18*a*, 20*a* and one of the intermediate segments are arranged following the meshing segment 38, wherein the switch segment 14*a* immediately follows the meshing segment 38*a*. The disengagement segment 40*a* is arranged immediately after the last switch segment 20*a*. The meshing segment 38*a* has an increasing radial depth. The intermediate segments 29*a*, 31*a*, 33*a* and the switch segments 14*a*, 16*a*, 18*a*, 20*a* have a constant radial depth. By means of the decreasing radial depth of the disengagement segment 40*a*, the switch element 25*a* of the switch unit 23*a* is moved back into its neutral position, in which it is outside an engagement into the shifting gate 13*a*.

The meshing segment 38*a*, the intermediate segments 29*a*, 31*a*, 33*a* and the disengagement segment 40*a* are respectively partially arranged on the cam element 11*a* and partially on the cam element 12*a*. The switch segments 14*a*, 16*a*, 18*a*, 20*a* are respectively arranged completely on one of the cam elements 11*a*, 12*a*, wherein successive switch segments 14*a*, 16*a*, 18*a* 20*a* are alternately arranged on the cam elements 11*a*, 12*a*. The switch segment 14*a* and the switch segment 18*a* are provided to displace the cam element 11*a*. The switch segment 16*a* and the switch segment 20*a* are provided to displace the cam element 12*a*.

The second gate path 37*a* is formed analogously to the first gate path 36*a*. Following the meshing segment 39*a*, one of the switch segments 15*a*, 17*a*, 19*a*, 21*a* and one of the intermediate segments 30*a*, 32*a*, 34*a* are also arranged alternately. The disengagement segment 41*a* immediately follows the last switch segment 21*a*. The meshing segment 39*a*, the intermediate segments 30*a*, 32*a*, 34*a* and the disengagement segment 41*a* are respectively partially arranged on the cam element 11*a* and partially on the cam element 12*a*. The switch segments 15*a*, 17*a*, 19*a*, 21*a* are respectively arranged completely on one of the cam elements 11*a*, 12*a*, wherein successive switch segments 15*a*, 17*a*, 19*a*, 21*a* are alternately arranged on the cam element 11*a*, 12*a* that they can displace.

Three different switching positions of the cam elements 11*a*, 12*a* can be switched by means of the switch segments 14*a*-21*a*. The cam element 11*a* and the cam element 12*a* respectively have at least one cam unit 43*a*, 47*a* with three partial cams 44*a*-46*a*, 48*a*-50*a*. The partial cams 44*a*-46*a*, 48*a*-50*a* have a different lift height and are assigned to the switching positions of the cam elements 11*a*, 12*a*.

The partial cams 44*a*, 48*a* with the highest lift height are assigned to the switching positions with the full lift. The partial cams 45*a*, 49*a* with a medial lift height are assigned to the switching positions with a partial lift. The partial cams 46*a*, 50*a* with the lowest lift height, which is advantageously equal to zero, are assigned to the switching positions with a zero lift. The partial cams 44*a*, 48*a* with the highest lift height and the partial cams 46*a*, 50*a* with the lowest lift height are arranged at the outside in the corresponding cam units. The partial cams 45*a*, 49*a* with the median lift height are arranged between the other partial cams 44*a*, 46*a*, 48*a*, 50*a* of the corresponding cam unit 43*a*, 47*a*.

For displacing the cam elements 11*a*, 12*a*, the actuating device 10*a* has the two switch units 23*a*, 24*a*. The first switch unit 23*a* has a first actuator 27*a* and a first switch element 25*a*. The switch element 25*a* is partially formed as a switch pin 51*a*, which is extended in a switching position of the first switch element 25*a*. In the switching position, the switch pin 51*a* engages the first gate path 36*a* of the shifting gate 13*a*. The cam elements 11*a*, 12*a* can be displaced into the first switching direction by means of the first switch unit 24*a* and the first gate path 36*a*.

The second switch unit 24*a* has a second actuator 28*a* and a second switch element 26*a*. The second switch element 26*a* is also partially formed as a switch pin 52*a*, which is extended in a switching position of the second switch element 26*a*.

In a switching position, the switch pin 52*a* engages a second gate path 37*a* of the shift gate 13*a*. By means of the second switch unit 24*a* and the second gate path 37*a*, the cam elements 11*a*, 12*a* can be displaced into the second switch direction opposite the first switch direction.

The cam elements 11*a*, 12*a* are partially coupled to each other via the shifting gate in an interactive manner. The cam elements 11*a*, 12*a* can be displaced sequentially by means of the actuating device 10*a*. The cam elements 11*a*, 12*a* are thereby displaced in dependence on a rotary angle of the base cam shaft 35*a* or of the cam elements 11*a*, 12*a*. In the first switching direction, the first cam element 11*a* is initially displaced, and subsequently, when the first cam element 11*a* is completely displaced, the second cam element 12*a* is displaced. In the second switching direction, the second cam element 12*a* is initially displaced, and subsequently the first cam element 11*a*. The cam elements 11*a*, 12*a* are thereby always displaced in a base circle phase of their cam units 43*a*, 47*a*.

The first cam element 11*a* is designed in two parts and has two cam element parts 53*a*, 54*a*, which are arranged on both sides of the second cam element 12*a*. The cam element parts 53*a*, 54*a* are rigidly connected to each other for an axial movement by means of an interior coupling bar 55*a*. In principle, it is also conceivable to arrange the two cam element parts 53*a*, 54*a* adjacent to each other and to design them in one piece. The first actuator 11*a*, which moves the first shifting element 13*a*, has an electromagnetic unit 56*a*. The electromagnetic unit 56*a* comprises a solenoid 57*a*, which is arranged in a stator 58*a* of the electromagnetic unit 56*a*. A magnetic field can be generated by means of the solenoid 57*a*, which field interacts with a permanent magnet 59*a*, which is arranged in the shifting element 25*a*. The switch element 25*a* can thereby be extended with the switch pin 51*a*. A core 60*a* reinforces the magnetic field generated by the electromagnetic unit 56*a*.

If the solenoid 57*a* has no current, the permanent magnet 59*a* interacts with the surrounding material. In the neutral position, the permanent magnet 59*a* interacts with the core 60*a* of the electromagnetic unit 56*a*, which consists of a magnetizable material. In the switching position, the permanent magnet 59*a* interacts with the stator 58*a* of the actuator 27*a*. In an operating state without current, the permanent magnet 59*a* stabilizes the switch element 25*a* in the switching position or the neutral position.

In an operating state, in which the electromagnetic unit 56*a* is supplied with a current, the permanent magnet interacts with the field of the electromagnetic unit 56*a*. Depending on a polarization of the permanent magnet 59*a* and the electromagnetic unit 56*a*, an attracting force and a repelling force can thereby be generated. A polarization of the electromagnetic unit 56*a* can be changed by means of a current direction, by means of which the electromagnetic unit 56*a* is supplied with a current. In order to extend the switch element 25*a* from its neutral position into the switch position, the electromagnetic unit 56*a* is energized in the current flow direction, which results in a repellent force between the electromagnetic unit 56*a* and the permanent magnet 59*a*.

The actuator 11*a* includes further a spring unit 61*a*, which also exerts a force on the switch element 25*a*. The force of the spring unit 61*a* is directed in a direction which corresponds to a direction of the repelling force between the electromagnetic unit 56*a* and the permanent magnet 59*a*, whereby an extension action of the switch element 25*a* can be accelerated.

The second actuator 12*a* is constructed analogously to the first actuator. It comprises an electromagnetic unit 62*a*, which has a solenoid 63*a* arranged in a stator 58*a* with a magnetizable core 64*a* designed commonly for both actuators 27*a*, 28*a*, which interacts with a permanent magnet 365*a* arranged in the switch element 26 and which can extend the switch pin 52*a*. An extension process is also actuated by a spring unit 66*a* with the actuator 28*a*.

The two actuators are arranged in a common base housing part 67*a*, which simultaneously forms the stator 58*a* of the actuators 27*a*, 28*a* formed in one piece. The solenoids 57*a*, 63*a* of the actuators 27*a*, 28*a* are also wound around the base housing part 67*a*. A further housing part 68*a* is connected to the base housing part 67*a*. The further housing part 68*a* encloses both actuators 27*a*, 28*a*. The housing part 68*a* additionally has guides for the switch elements 25*a*, 26*a*.

In order to be able to withdraw the switch elements 25*a*, 26*a* at a time that is independent of the disengagement segments 40*a*, 41*a*, the actuating device 10*a* has a coupling element 69*a*, by means of which the first switch element 25*a* and the second switch element 26 are coupled to each other in an interactive manner (see FIG. 1 and FIG. 2). The coupling element couples the two switch elements 25*a*, 26*a* to each other in a complementary manner. The second switch element 26*a* can thereby be moved into the neutral position by means of the first actuator 27*a* and the first switch element 25*a* by means of the second actuator 28*a*. The coupling element 69*a* thus forms a part of a reset unit 22*a*, by means of which the switch elements 25*a*, 26*a* can be reset to their neutral position and a switching process can thus be terminated prematurely.

The coupling element 69*a* is supported between the switch elements 25*a*, 26 in a rotatable manner. The two switch elements 25*a*, 26*a* respectively have a recess 70*a*, 71*a*, into which the coupling element 69*a* engages. The switch elements 25*a*, 26*a* are connected to each other in an interactive manner by means of the recesses 70*a*, 71*a*. The coupling element thereby provides a rocking mechanism which couples the switch elements 25*a*, 26*a* in a complementary manner.

The second switch element 26*a* is moved into the neutral position by Means of the first actuator in that the first switch element 25*a* is moved into the switching position. The first switch element 25*a* is moved into the neutral position by means of the second actuator 28*a* in that the second switch element 26*a* is moved into the switching position. In principle, both switch elements 25*a*, 26*a* can also be moved back into the base position by means of the disengagement segments 40*a*, 41*a*. It is furthermore advantageous if the actuator 27*a*, 28*a* of the switch element that shall be moved into the neutral position, is additionally energized in the current flow direction, in which the electromagnetic unit exerts an attracting force and supports the movement of the switch element 25*a*, 26*a* into the neutral position.

By means of the actuating device 10*a*, the cam element 11*a* can for example be switched into the switching position with partial stroke and the cam element 12*a* into the switching position with zero stroke. If both cam elements 11*a*, 12*a* are in the switching position with zero stroke, the switch element 25*a* of the first switch unit 23*a* is extended and engages the first gate path 36*a*. By means of the switch segment 14*a* following the meshing segment 38*a*, the cam element 11*a* is displaced from the switching position with zero stroke into the switching position with partial stroke. Subsequently, the switch element 26*a* of the second switch unit 24*a* is extended again. The second switch element 26*a* meshes in the disengagement segment 41*a* of the second gate path 37*a*. The switch element 25*a* of the first switch unit 23*a* is thereby moved back into the neutral position. The switch element 26*a* of the second switch unit 24*a* is moved back into its neutral position by the disengagement segment 59.

Further possible switching actions, as for example a switching action that switches the cam element 11*a* into the switching position with a full stroke and switches the cam element 12*a* into the switching position with zero stroke, take place analogously to the above example and result directly from the description and the drawings. A detailed description can be forgone here.

In FIGS. 5 to 8 is shown a further embodiment of the invention. For distinguishing the embodiments, the letter a in the reference numerals of the embodiment in FIGS. 1 to 4 is replaced by the letter b in the reference numerals of the embodiment in FIGS. 5 to 8. With the following description, the description of the embodiment in FIGS. 1 to 4 can be referred to with regard to the same components, characteristics and functions.

Figure 5:
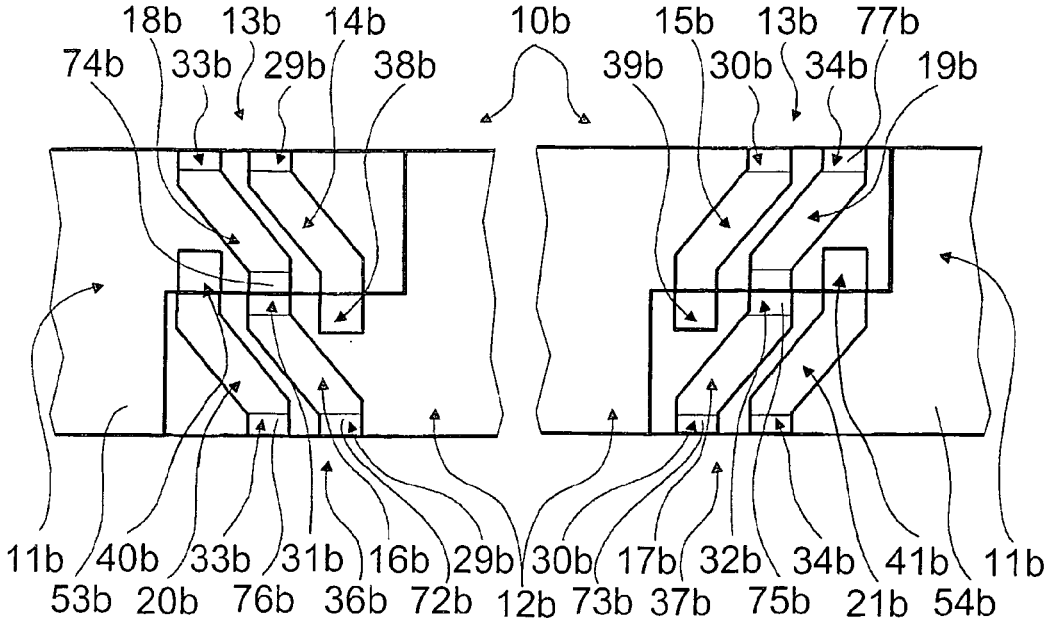

FIG. 5 shows a further embodiment of a shifting gate 13*b* of an actuating device 10*b* of a valve train device. The actuating device 10*b* is provided to move two cam elements 11*b*, 12*b* which are arranged on a base camshaft 35*b* in an axially displaceable and torque-proof manner. In order to move the cam elements 11*b*, 12*b*, the actuating device 10*b* has a first switch unit 23*a* and a second switch unit 24*b*, which can displace the cam elements 11*b*, 12*b* by means of the shifting gate 13*b*.

The shifting gate 13*b* has a first gate path 36*b* and a second gate path 37*b*. The gate paths 36*b*, 37*b*, by means of which the cam elements 11*b*, 12*b* can be displaced, are groove-shaped recesses and are directly formed into the cam elements 11*b*, 12*b*. In order to displace the cam elements 11*b*, 12*b* sequentially, the cam elements 11*b*, 12*b* are designed L-shaped and intersecting axially in a region where they abut (see FIG. 7). In the circumferential region, each cam element 11*b*, 12*b* takes on a rotational angle of 180° degrees in the region of the shifting gates. The gate paths 36*b*, 37*b*, which extend over a rotary angle larger than 360° degrees, are respectively partially arranged on the cam element 11*b* and partially on the cam element 12*b*.

Both gate paths 36*b*, 37*b* have a base shape with a fourfold S-shaped structure (see FIG. 5). Both gate paths 36*b*, 37*b* respectively have a meshing segment 38*b*, 39*b*, four switch segments 14*b*-21*b*, three intermediate segments 29*b*-34*b* and a disengagement segment 40*b*, 41*b*. The switch segments 14*b*, 16*b*, 18*b*, 20*b* of the first gate path 36*b* have an axial direction component which is opposed to a first switching direction, whereby an axial force for switching into the first switching direction can be generated by means of the switch segments 14*b*, 16*b*, 18*b*, 20*b* and a rotational movement of the cam elements 11*b*, 12*b*. The switch segments 15*b*, 17*b*, 19*b*, 21*b* of the second gate path 37*b* have an axial direction component which is directed axially opposed to a second switching direction, whereby a force for switching into the second switching direction can be generated analogously.

In the first gate path 36*b*, one of the switch segments 14*b*, 16*b*, 18*b*, 20*b* and one of the intermediate segments 29*b*, 31*b*, 33*b* are alternately arranged following the meshing segment 38*b*, wherein the switch segment 14*b* immediately follows the meshing segment 38*b*. The disengagement segment 40*b* is arranged immediately after the last switch segment 20*b*. The meshing segment 38*b* has an increasing radial depth. The switch segments 14*b*, 16, 18*b*, 20*b* have a constant radial depth. The disengagement segment 40*b* has a decreasing radial depth. By means of the decreasing radial depth of the disengagement element 40*b* a switch element 25*b* of the first switch unit 23*b* is moved back into its neutral position in which it is outside an engagement with the shift gate The meshing segment 38*b*, the intermediate segments 29*b*, 31*b*, 33*b* and the disengagement segment 40*b* are respectively partially arranged on the cam element 11*b* and partially on the cam element 12*b*. The switch segments 14*b*, 16*b*, 18*b* 20*b* are respectively arranged completely on one of the cam elements 11*b*, 12*b*, wherein successive switch segments 14*b*, 16*b*, 18, 20*b* are arranged alternately on the cam elements 11*b*, 12*b*. The switch segment 14*b* and the switch segment 18*b* are provided to displace the cam element 11*b*. The switch segment 16*b* and the switch segment 20*b* are provided to displace the cam element 12*b*.

The second gate path 37*b* is formed analogously to the first gate path 36*b*. Following the meshing segment 29*b*, one of the switch elements 15*b*, 17*b*, 19*b*, 21*b* and one of the intermediate segments 30*b*, 32*b*, 34*b* are also arranged alternately. The disengagement element 41*b* immediately follows the last switch segment 21*b*. The meshing segment 38*b*, the intermediate segments 30*b*, 32*b*, 34*b* and the disengagement segment 41*b* are respectively partially arranged on the cam element 11*b* and partially on the cam element 12*b*. The switch segments 15*b*, 17*b*, 19*b*, 21*b* are respectively arranged completely on one of the cam elements 11*b*, 12*b*, wherein successive switch segments 15*b*, 17*b*, 19*b*, 21*b* are arranged alternately on the cam elements, which they can displace.

Figure 6:
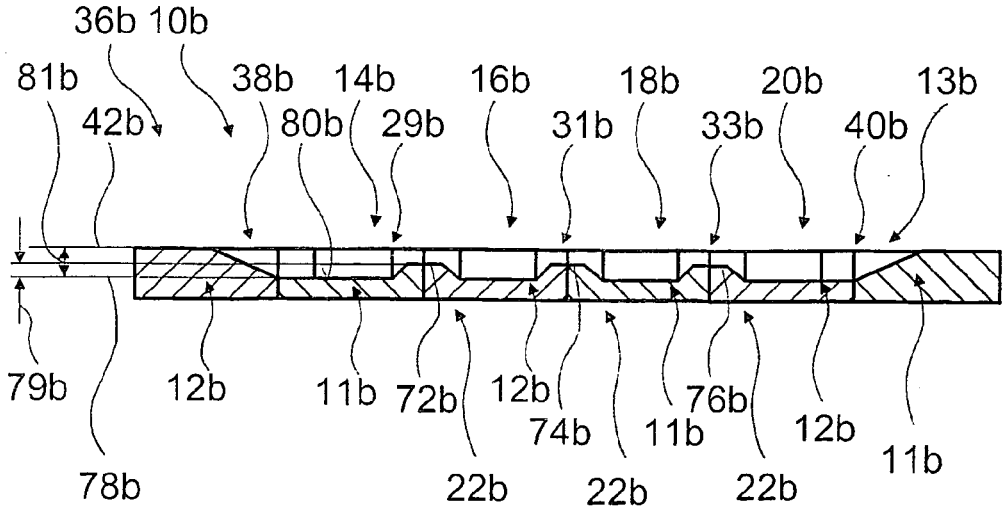

Three different switching positions of the came elements 11*b*, 12*b* can be switched by means of the switch segments 14*b*-21*b* (see FIG. 6). The cam element 11*b* and the cam element 12*b* respectively have at least one cam unit 43*b*, 47*b* with three partial cams 44*b*-46*b*, 48*b*-50*b*. The partial cams 44*b*-46*b*, 48*b*-50*b* have a different lift height and can be assigned to switching positions of the cam elements 11*b*, 12*b*.

The partial cams 44*b*, 48*b* with the highest lift height are assigned to switching positions with a full lift. The partial cams 45*b*, 49*b* with a median lift height are assigned to switching positions with a partial lift. The partial cams 46*b*, 50*b* with the lowest lift height, which is advantageously equal to zero, are assigned to switching positions with zero lift. The partial cams 44*b*, 48*b* with the highest lift height and the partial cams 46*b*, 50*b* with the lowest lift height are arranged on the outside in the corresponding cam units 43*b*, 47*b*. The partial cams 45*b*, 49*b* with the median lift height are arranged between the other partial cams 44*b*, 46*b*, 48*b*, 50*b* of the corresponding cam unit 43*b*, 47*b*.

The actuating device has the two switch units 23*b*, 24*b* for displacing the cam elements 11*b*, 12*b*. The first switch unit 23*b* has a first actuator 27*b* and a first switch element 25*b*. The switch element 25*b* is partially formed as a switch pin 51*b*, which is extended in a switch position of the first switch element 25*b*. In the switching position, the switch pin 51 b engages the first gate path 36*b* of the shifting gate 13*b*. The cam elements 11*b*, 12*b* can be displaced into the first switching direction by means of the first switch unit 23*b*.

Figure 7:
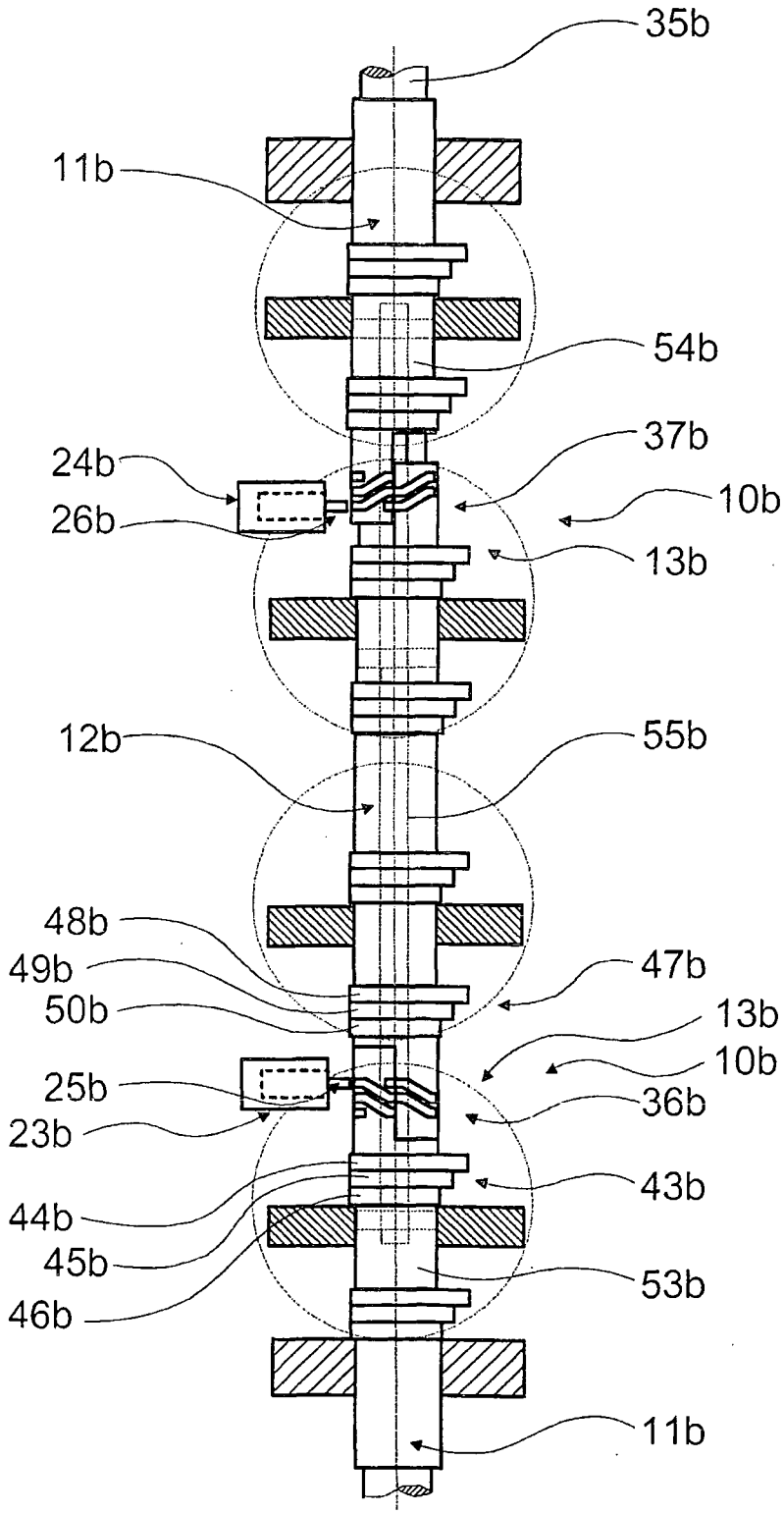
Figure 8:
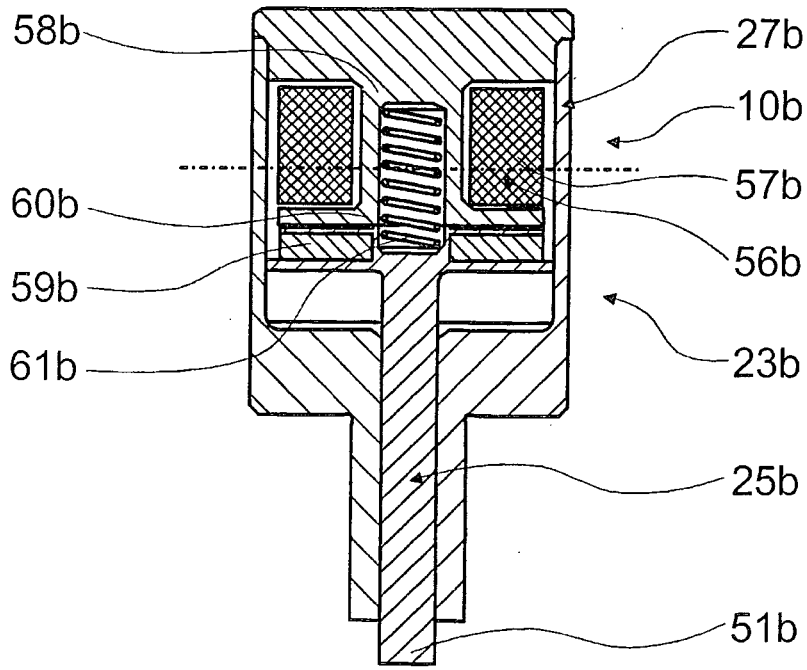

As shown in FIGS. 7 and 8 the first actuator 27*b*, which moves the first switch element 25*b*, has an electromagnet unit 56*b*. The electromagnetic unit 56*b* comprises a solenoid 57*b*, which is arranged in a stator 58*b* of the electromagnetic unit 56*b*. A magnetic field can be generated by means of the solenoid 57*b*, which field interacts with a permanent magnet 59*b*, which is arranged in the switch element 25*b*. The switch element 25*b* can thereby be extended with the switch pin 51*b*. A core 60*b* reinforces the magnetic field generated by the electromagnetic unit 56*b*.

If the solenoid 57*b* is deenergized, the permanent magnet 59*b* interacts with the surrounding material. In the neutral position, the permanent magnet 59*b* interacts with the core 60*b* of the electromagnetic unit 59*b*, which consists of a magnetizable material. In the switching position, the permanent magnet 59*b* interacts with the stator 58*b* of the actuator 27*b*. When deenergized, the permanent magnet 59*b* stabilizes the switch element 25*b* in the switching position or the neutral position.

In an operating state, in which the electromagnetic unit 56*b* is energized, the permanent magnet 59*b* interacts with the field of the electromagnetic unit 56*b*. Depending on a polarization of the permanent magnet 59*b* and the electromagnetic unit 56*b*, an attracting force and a repelling force can thereby be realized. A polarization of the electromagnetic unit 56*b* can be changed by means of the direction, of the current energizing the electromagnetic unit 56*b*. In order to move the switch element 25*b* from its neutral position into the switching position, the electromagnetic unit 56*b* is energized by current in the flow direction, which results in a repellent force between the electromagnetic unit 56*b* and the permanent magnet 59*b*.

A spring unit 61*b* is further arranged in the actuator 27*b*, which also exerts a force on the switch element 25*b*. The force of the spring unit 61*b* is directed into a direction which corresponds to a direction of the repelling force between the electromagnetic unit 56*b* and the permanent magnet 59*b*, whereby an extension process of the shifting element 25*b* is accelerated.

The second switch unit 24*b* is analogous to the first switch unit 23*b*. The second switch unit hast a switch pin 52*b* which engages the gate path 36*b* in a switching position of the switch element 25*b*. By means of the second switch unit 24*b* and the second gate path 37*b*, the cam elements 11*b*, 12*b* can be displaced into the second switching direction opposed to the first switching direction. The cam elements 11*b*, 12*b* are partially coupled to each other via the shifting gate in an interactive manner. The cam elements 11*b*, 12*b* can be displaced sequentially by means of the actuating device 10*b*. The cam elements 11*b*, 12*b* are thereby displaced in dependence on a rotary angle of the base camshaft 35*b*. In the first switching direction, the cam element 11*b* is initially displaced, and subsequently, when the cam element 11*b* is completely displaced, the cam element 12*b* is displaced. In the second switching direction, the cam element 12*b* is initially displaced, and subsequently the cam element 11*b*.

The cam element 11*b* is designed in two parts and has two cam element parts 53*b*, 54*b*, which are arranged at opposite ends of the cam element 12*b*. The cam element parts 53*b*, 54*b* are rigidly connected to each other for an axial movement by means of an interior coupling bar 55*b*. In principle, it is also conceivable to arrange the two cam element parts 53*b*, 54*b* adjacent to each other and to design them in one piece.

In order to be able to move the switch elements back at a time which is independent from the disengagement segments 40*b*, 41*b*, each intermediate segment 29*b*-34*b* of the gate paths 36*b*, 37*b* of the shifting gate 13 respectively has a reset element 72*b*-77*b* (see FIG. 5). By means of the reset elements 72*b*-77*b*, the switch element 25*b*, 26*b*, which engages the corresponding gate path 36*b*, 37*b*, can be displaced back into their neutral positions. The reset elements 72*b*-77*b* thus form a reset unit 22*b*, by means of which a switching action can be terminated prematurely.

The reset elements 72*b*-77*b* are all designed in the same manner, which is why the following description of the reset element 72*b* can also analogously be transferred to the remaining reset elements 73*b*-77*b*. The reset element 72*b* is designed as an elevation over a gate path base level 78*a* and is completely arranged in the first gate path 36*b*. In the region of the reset element 72*b*, a radial height 79*b* of a gate path base 80*b* increases or the radial depth of the first gate path 36*b* decreases. Height A radial extension 81*b* of the gate path, which is formed by a distance between a shifting gate base level 42*b* which corresponds to the radial depth of the first gate path 36*b*, is thereby always larger than zero (see FIG. 6).

The two cam elements 11*b*, 12*b* can be switched into arbitrary switching positions by means of the reset elements 72*b*-77*b*. If for example the cam element 11*b* is to be switched from the switching position with zero lift into the switching position with full lift, and the cam element 12*b* from the switching position with zero lift into the switching position with partial lift, the first switch element 25*b* is extended and brought into engagement with the first gate path 36*b* by means of the meshing segment.

The first cam element 11*b* is moved from the switching position with zero lift into the switching position with partial lift by means of the following switch segment 14*b*. The intermediate segment 29*b* with the reset element 72*b* follows the switch segment 14*b*. In order to prevent that the switch element 25*b* is moved into the neutral position by means of the reset element 72*b*, the electromagnetic unit 56*b* of the first actuator 27*b* is supplied with current and the switch element 25*b* follows a contour of the intermediate segment 29*b*. Subsequently, the second cam element 12*b* is moved from the switching position with zero lift into the switching position with partial lift by means of the following switch segment. The intermediate segment 31*b* with the reset element 74*b* follows the switch segment 16*b*. While the switch element 25*b* passes through the intermediate segment 31*b*, the actuator 27*b* is again energized and the switch element follows a contour of the intermediate segment 31*b*. The first cam element 11*b* is switched from the switching position with partial lift into the switching position with full lift by means of the following switch segment 18*b*. The intermediate segment 33*b* with the reset element 76*b* follows the switch segment 18*b*. While the switch element 25*b* passes through the intermediate segment 33*b*, the actuator 27*b* remains deenergized. The switch element 25 is thereby moved back into its neutral position by the reset element 76*b*, whereby the switch element 25*b* is outside an engagement into the first gate path 36*b* and the second cam element 12*b* remains in the switching position with partial lift.

Further switching actions can be realized analogously to the shown switching action. As these proceed with a same scheme and result directly from the above description or the Figures, a detailed description is not necessary.

What is claimed is:

1. A valve drive train device, of an internal combustion engine including a camshaft (35*a*) with at least one axially displaceable first cam element (11*a*, 11*b*) having axially overlapping movable first and second cam element sections (11*a*, 12*a*; 11*b*, 12*b*) provided with a shift gate (13*a*,13*b*) for sequentially displacing the first cam element section (11*a*, 11*b*) and the second cam element section (12*a*, 12*b*) on the camshaft (35*a*), and an actuating device (10*a*, 10*b*) for displacing the axially displaceable cam element sections (11*a*, 12*a*; 11*b*, 12*b*) by means of the shift gate (13*a*; 13*b*) to at least three switching positions, the shift gate (13*a*; 13*b*) having at least two gate tracks (36*a*, 37*a*; 36*b*, 37*b*), each including four switch segments (14*a*-21*a*; 14*b*-21*b*) and the switch segments being assigned to a gate track (36*a*, 37*a*:36*b*,37*b*) of a switching direction, the gate tracks (36*a*, 37*a*; 36*b*, 37*b*) extending over a rotational angle in excess of 360° and being arranged in each case partially on the first cam element section (11*a*; 11*b*) and partially on the second cam element section (12*a*, 12*b*).

2. The valve drive train device according to claim 1, wherein the actuating device (10*a*; 10*b*) is provided to switch the at least one axially displaceable cam element to one of a zero lift, a partial lift and a full lift position.

3. The valve drive train device according to claim 1, wherein in each case two of the switching segments (14*a*-21*a*; 14*b*-21*b*) are provided to move the first cam element (11*a*, 11*b*) in the switching direction and two further switch segments (15*a*,17*a*, 19*a*,21*a*; 15*b*, 17*b*, 19*b*, 21*b*), are provided for displacing the second cam element (12*a*, 12*b*) in the switching direction.

4. The valve drive train device according to claim 1, the switching elements (14*a*-21*a*, 14*b*-21*b*) are in each case alternatively assigned to the cam elements (11*a*, 12*a*; 11*b*, 12*b*), whereby the shifting gate (13*a;* 13*b*) is provided for sequentially displacing the first cam element (11*a*; 11*b*) and a second cam element (12*a*; 12*b*) depending on a rotational position angle of the cam elements (11*a*, 12*a*; 11*b*, 12*b*).

5. The valve drive train device according to claim 1, wherein the actuating device (10*a*; 10*b*) has a reset unit (22*a*; 22*b*) which is provided for terminating a switching action immediately after a displacement of the first cam element (11*a*, 11*b*) or after a displacement of the second cam element (12*a,* 12*b*) before reaching an end of the shifting gate (13*a*, 13*b*).

6. The valve drive train device according to at least claim 5, wherein the reset unit (22*a*) has switching units (23*a*,24*a*) which include first and second actuators (27*a*, 28*a*) and the switch elements (25*a*, 26*a*)are movable into a neutral position by means of an actuator (27*a*, 28*a*), the actuating device (10*a*) including a coupling element (69*a*) by means of which the first and second switch elements (25*a*, 26*a*) are coupled for movement together whereby the second switch element is moved by the first actuator (27*a*) and the first switch element can be moved by the second actuator (28*a*) into the neutral position.

7. The valve drive train device according to at least claim 5, wherein the shifting gate (13*b*) has at least one intermediate segment (29*b*-34*b*) with a reset element (72*b*-77*b*) in the form of an area raised over a gate path base level (78*b*), but is disposed fully within the guide path (36*b*, 37*b*) and which is provided to terminate the switching action ahead of an end of the shift gate (13*b*).

8. The valve drive train device according to claim 4, wherein between the switch segments (14*b*-21*b*) in each case an intermediate segment (29*b*-24*b*) is arranged.

9. The valve drive train device according to claim 1, wherein the actuating device (10*a*, 10*b*) includes two switching units (23*a*, 24*a*; 23*b*, 24*b*) each with a switching element (25*a*, 26*a*; 25*b*, 26*b*) in the form of a switching pin (51*a*, 52*a;*51*b*, 52*b*) wherein the switching pin (51*a*, 51*b*) of the first switching unit (23*a,* 23*b*) is engaged in an extended position in the first gate track (36*a*, 36*b*) and the switching pin (52a, 52b) of the second switching unit (24a, 24b) is engaged in the extended position in the second gate track (37*a*, 37*b*).

* * * * *